US005119798A

United States Patent [19]

Scott

[11] Patent Number: 5,119,798

[45] Date of Patent: Jun. 9, 1992

[54] ABRASIVE CUTTING APPARATUS INCLUDING INVERTED CUTTING CHAIN WITH INWARD FACING CUTTING ELEMENTS

[75] Inventor: Lewis A. Scott, Lake Oswego, Oreg.

[73] Assignee: Blount, Inc., Montgomery, Ala.

[21] Appl. No.: 577,258

[22] Filed: Sep. 4, 1990

[51] Int. Cl.[5] ..... B28D 1/08

[52] U.S. Cl. ..... 125/21; 125/22

[58] Field of Search ..... 125/21, 22, 18; 83/788, 83/661; 299/82, 83

[56] References Cited

U.S. PATENT DOCUMENTS

| | | | |
|---|---|---|---|
| 2,085,756 | 7/1937 | Joy | 125/21 |
| 2,869,534 | 1/1959 | Stihl | 125/21 |
| 4,735,188 | 4/1988 | Kubo | 125/21 |
| 4,920,947 | 5/1990 | Scott et al. | 125/22 |

*Primary Examiner*—M. Rachuba

*Attorney, Agent, or Firm*—Klarquist, Sparkman, Campbell, Leigh & Whinston

[57] ABSTRACT

An abrasive cutting apparatus including a cutting chain formed of pivotally connected links is described for cutting rock, concrete and the like. The abrasive cutting chain is inverted so that its cutter links having abrasive cutting elements fixed thereto face inwardly of the endless loop of chain. A motor driven drive pulley having a groove which may be provided with an elastomer liner, engages the cutter links to drive the chain. A pair of idler pulleys with grooves that engage an outward projection on each of the center links of the chain guide the movement of the chain to provide lateral stability and proper tension to such chain. A releasable connection formed by a pair of connector side links and a connector pin with intermediate portions of reduced diameter, is employed to connect chain sections of standard length to form an endless chain of adjustable length and to enable replacement of broken sections in the field manually without the use of special tools.

18 Claims, 2 Drawing Sheets

ABRASIVE CUTTING APPARATUS INCLUDING INVERTED CUTTING CHAIN WITH INWARD FACING CUTTING ELEMENTS

FIELD OF THE INVENTION

The present invention relates generally to abrasive cutting apparatus for cutting of rocks, concrete, masonry and the like by means of a flexible cutting chain having abrasive cutting elements thereon, and in particular to such a cutting chain in which the cutting links are inverted so that the abrasive cutting elements face inwardly during cutting. The cutting links are engaged by a motor driven drive pulley for driving the chain during cutting. The cutting elements are preferably each fixed on a pair of side cutting links of the chain provided on opposite sides of center links. The center links extend outwardly and are engaged by guide pulleys to stabilize the chain against lateral movement and to adjust the tension on the chain. The abrasive cutting chain of the present invention avoids the use of a guide bar having a track which is normally employed to guide the movement of a cutting chain.

BACKGROUND OF THE INVENTION

It has been previously proposed to employ an abrasive cutting chain on the guide bar of a motor driven chain saw for cutting rock and other hard material as shown in U.S. Pat. No. 2869534 of Stihl, issued Jan. 20, 1959, and U.S. Pat. No. 2912968 of Stihl, issued Nov. 17, 1959. However, there are many problems when attempting to cut stone, concrete, and masonry or other hard material, with a chain saw using a chain having abrasive cutting elements. The abrasive cutting elements are formed of hard abrasive particles such as diamonds or silicon carbide held in a metal matrix which is attached to the cutting link by welding with sufficient strength to resist the high shock and high heat conditions of abrasive cutting. This requires complicated and expensive cutting links. As a result such cutter elements may be rotatably mounted on the links to reduce wear as in Stihl U.S. Pat. No. 2,912,968.

In addition, the drive sprocket and guide bar used in a chain saw for guiding the movement of the abrasive cutting chain, frequently become coated with rock dust or other comminuted material, which causes wear and friction that may unduly load the chain saw motor. This rock dust accumulation causes abrasion of the guide bar drive track, drive sprocket, and the chain links resulting in rough running and heating of the guide bar and the chain. Such abrasion also results in widening of the guide bar track and wear of the sprocket teeth, which causes the chain to be laterally unstable. In addition, the rock dust or other comminuted material can penetrate between the chain links causing wear of such links and their pivotal pin connections which may result in chain breakage. Also the chain can jump off the guide bar or sprocket due to the accumulation of the rock dust on the guide bar and sprocket. These problems are discussed in U.S. Pat. No. 3,384,417 of Mylewski, issued May 21, 1968. Attempts to overcome these problems have included the use of flow tubes on the chain saw to produce pressure streams of water directed against or through passages in the guide bar in order to clean out the rock dust from the guide bar track and to cool and lubricate the track and the chain moving on such track, as shown in U.S. Pat. No 3,593,700 of McNulty, issued Jul. 20, 1971, and U.S. Pat. No. 4,920,947 of Scott et al., issued May 1, 1990.

Another problem with an abrasive cutting chain saw is the need to regulate the power of such saw when cutting through rock and other material which is of varying consistency and hardness. It has been proposed in U.S. Pat. No. 4,181,115 of Weisner, issued Jan. 1, 1980, to provide a power control which senses reduced power consumption of the saw motor and generates a control signal to increase the speed of the saw feeding the chain through the material being cut or to decrease such speed when excessive power consumption is sensed. However, this does not eliminate the many other problems associated with the use of such a chain saw and its accompanying guide bar, as discussed above.

It has also been proposed more recently in German patent No. 3,332,051 of Mayer, issued Mar. 15, 1984, and in U.S. Pat. No. 4,920,947 of Scott et al. cited above to provide an abrasive cutting chain saw with a saw chain having abrasive cutting elements each secured on a pair of side links on opposite sides of the chain.

Another patent of interest is U.S. Pat. No. 4,461,269 of Elliott, issued Jul. 24, 1984, which is directed to the design of a special abrasive resistant chain saw sprocket having replaceable carbide steel teeth to overcome the abrasion caused by the rock dust produced by the chain saw.

All of these prior saw chains engage a track on a guide bar and are driven by a drive sprocket, unlike the abrasive cutting chain of the present invention, which wear quickly to cause most of the above-mentioned problems. The abrasive cutting apparatus of the present invention eliminates both the guide bar and the usual drive sprocket. In addition, the prior cutting elements extended outwardly of the chain for cutting in a conventional manner, and are not inverted to face inwardly and to engage a motor driven pulley in the manner of the present invention.

As a result of these many problems, the abrasive cutting of rocks, concrete, masonry and the like, is still performed, to a large extent, by abrasive cutting cable or wire employing abrasive cutter elements. In recent years the abrasive cutter elements are in the form of beads mounted in spaced relationship on a flexible cable or wire by shock absorbing coil springs, as shown in U.S. Pat. No. 4,674,474 of Baril, issued Jun. 23, 1987. This process of cutting rocks and other similar material using abrasive wire has been accepted practice in the stone cutting industry for hundreds of years. Even though this conventional stone cutting process has been improved in recent years by the introduction of a flexible cable or wire having abrasive cutter elements such as diamond matrix beads resiliently mounted on such cable or wire as shown in the above-cited Baril patent, there remain a number of problems associated with this cutting process. First, the abrasive cutting cable or wire must be made into a plurality of different lengths to match specific cutting applications including the size and location of the rock, concrete or other material being cut. In addition the cutting machine driving the flexible cable must be provided on a track of sufficient length of travel to allow such machine to pull the selected length of cutting wire through the rock to complete the cut. Second, cable breakage occurs frequently and is extremely difficult to repair in the field resulting in the loss of expensive diamond cutting elements and interruption in operation of the cutting equipment for significant periods of time for repair or until replacement cables can be supplied. Third, diamond cutting beads mounted on the cable find a preferred rotational location on the cable and wear through for premature breakage of the diamond beads with up to thirty-five percent of the diamond wear life remaining. Fourth, breakage of a cutting cable is extremely dangerous when it occurs in the field since it can strike the operator or other persons in the work area, and this danger also exists when the cable completes a cut due to the sudden release of stored energy in the cable. Such a cutting cable follows a path of decreasing radius as it is pulled through a cut in a rock thereby increasing the probability of breakage as it completes the cut. Also, unlike relatively stiff cables, a chain with pivoted links forms at its looped end an unrestrained parabolic curved cutting path through the rock or other work piece. Cables however have a considerable resistance to bending and develop high stress points when they move along a course which tends to move the cable out of its cutting plane and to cause breakage of the cable.

It has been found that the problems associated with an abrasive cutting cable of conventional construction and those associated with an abrasive cutting chain saw employing a conventional guide bar, can be reduced or eliminated by the present invention in which the abrasive cutting cable is replaced by a flat link abrasive cutting chain which is inverted and operated without using a guide bar. Of course, by eliminating the use of a guide bar and a drive sprocket, the improved abrasive cutting chain system of the present invention eliminates the problems of abrasive wear of the sprocket and the guide bar track and lateral instability of the chain due to such wear. Thus, in the present invention, the chain is inverted so that its cutter links have their abrasive cutting elements facing inward and such cutting elements are engaged by a motor driven pulley in order to drive the cutting chain. In addition, the operation of such inverted cutting chain can be improved by causing an outer projection portion on each of the center links of the chain which extends outwardly therefrom to engage a groove in each of a pair of idler pulleys which guide movement of the chain to provide lateral stability during cutting and apply tension to the chain. Such improved abrasive cutting chain is assembled in standard lengths which are connected together by releasable connector links that may be disconnected and reconnected manually to provide chain assemblies of many different selected lengths. In addition by removing selected standard length or adding standard lengths, the length of the assembled chain can be changed using the releasable connector links to suit different cutting conditions and to replace broken standard lengths in the field.

SUMMARY OF THE INVENTION

It is therefore one object of the present invention to provide an improved abrasive cutting apparatus including an abrasive cutting chain for cutting rocks, concrete, masonry and the like which overcome the above-discussed lateral instability, over heating, and abrasion wear problems by not employing a guide bar to guide the movement of such chain.

Another object of the invention is to provide such an abrasive cutting apparatus which avoids the above-discussed problems of sprocket wear and chain drive slippage by eliminating the use of a motor driven sprocket for driving the chain, and inverting the cutter links on the chain so that the cutting elements on such cutter links face inwardly and are positioned to engage a motor driven pulley for driving the cutting chain.

A further object of the invention is to provide such an improved cutting chain with greater lateral stability in which outward projections on some of the links of such chain, such as center links, project outwardly into engagement with grooves in guide pulleys positioned on opposite sides of the upper and lower reaches of the continuous loop of chain.

An additional object of the invention is to provide such an abrasive cutting chain which is made of a plurality of standard lengths of chain which are connected together by releasable connection links in order to vary the length of the chain assembly or to enable repair and replacement of damaged chain sections in a simple and rapid manner in the field manually.

Still another object of the invention is to provide such an abrasive cutting chain in which the abrasive cutting elements are fixed to the cutting links of such chain so that such cutting elements wear more evenly and are not lost in the event that the chain breaks but can be reused by repair of the chain.

A still further object of the invention is to provide such an improved abrasive cutting chain which is capable of cutting a narrower cut through the rock or other hard material than an abrasive cutting cable and the danger of personal injury due to breakage of the chain is greatly reduced.

DESCRIPTION OF DRAWINGS

These and other objects and advantages of the present invention will be apparent from the following detailed description of a preferred embodiment thereof and from the attached drawings of which.

DESCRIPTION OF PREFERRED EMBODIMENT

Figures 1, 3:
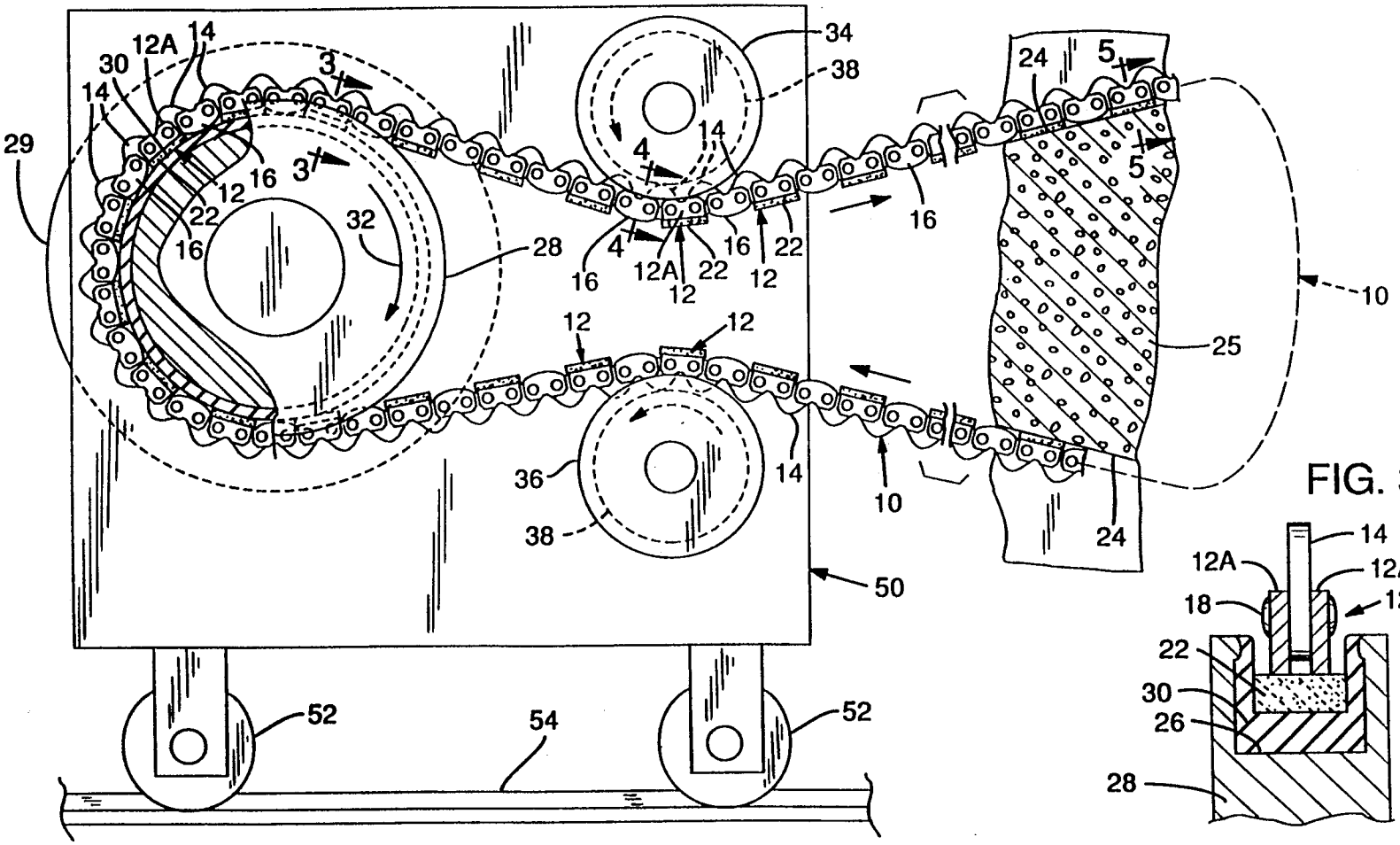
FIG. 1 is a side elevation view of an abrasive cutting apparatus in accordance with the present invention.
FIG. 3 is an enlarged section view of the drive pulley and cutting chain taken along the line 3—3 of FIG. 1.
Figure 2:
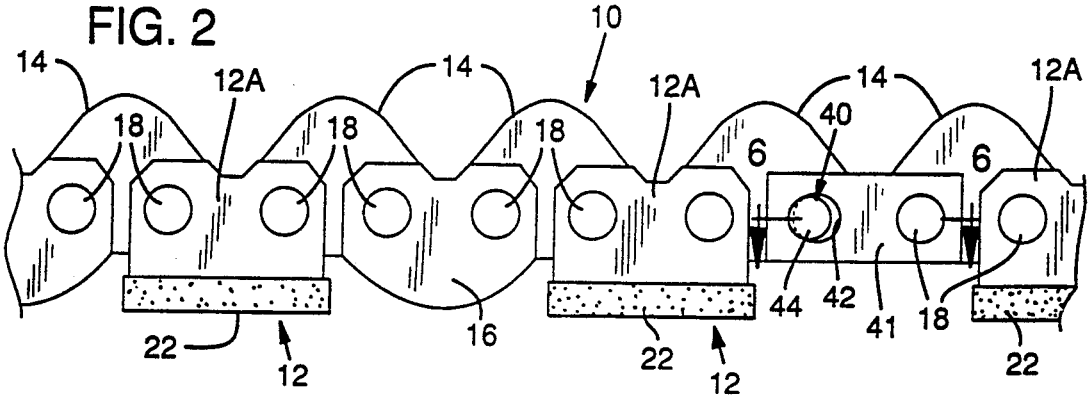
FIG. 2 is an enlarged side elevation view of a portion of the abrasive cutting chain used in the apparatus of FIG. 1.

As shown in FIGS. 1 and 2, the abrasive cutting apparatus of the present invention includes an abrasive cutting chain 10. The chain 10 has a plurality of cutter links 12 which may be side links 12A positioned upon the opposite sides of center links 14. The cutter links 12 are inverted so that cutting elements 22 fixed thereto face inward. The cutter links are spaced longitudinally apart by coupling links 16 which are also side links but without abrasive cutting elements attached thereto. The cutter links 12, center links 14, and coupling links 16 are pivotally coupled together by pivot pins in the form of rivets 18 extending through holes 20 in such links to connect them together and such rivets are provided with enlarged head portions on opposite sides of the chain to hold the rivets in place. Each cutter link 12 includes an abrasive cutting element 22 which preferably extends between, and is secured to, a pair of side links 12A on opposite sides of a center link 14 to connect such side links together thereby forming an integral cutting link 12. The abrasive cutting element 22 is formed of a matrix of hard abrasive particles such as diamond or silicon carbide particles fixedly secured in a suitable matrix material such as sintered metal powder. The abrasive cutting element 22 is fixed to the inner edge of the side links 12A by welding or the like.

Figure 5:
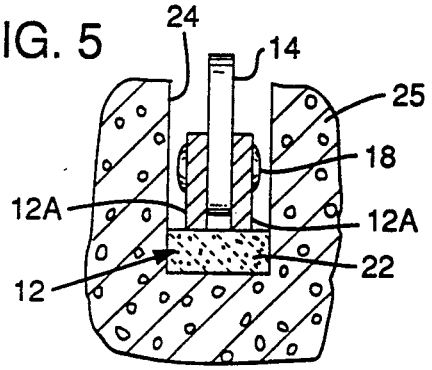
FIG. 5 is an enlarged section view of the material being cut and the cutting chain taken along the line 5—5 of FIG. 1.

As shown in FIGS. 2 and 5, the abrasive cutting element 22 of the cutter link 12 is of a generally rectangular shape and cross-section whose width is slightly wider than the enlarged heads of the rivets 18. As a result, the cutting elements form a saw cut or kerf 24 of a greater width that the main body of the cutting chain, including the side links 12A and 16, as well as the rivets attaching them to the center links 14. This allows clearance space between the sides of the kerf 24 and the main body of the chain.

As shown in FIG. 1, the cutter links 12 are inverted so that the cutting elements 22 of such cutter links face inwardly when they cut the rock or concrete 25. The cutting elements ride in a groove 26 in a motor driven pulley 28 which is connected to the output shaft of a motor 29 that drives the chain. The groove 26 of the drive pulley 28, may be provided with a resilient liner 30 of rubber or other elastomer material for increased frictional engagement with the cutting element 22 of the cutter links 12 for improved driving efficiency as shown in FIG. 3.

Figure 4:
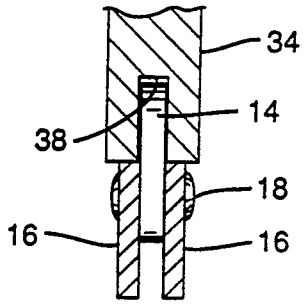
FIG. 4 is an enlarged section view of the guide pulley and cutting chain taken along the line 4—4 of FIG. 1.

The cutting chain 10 is an endless loop of chain which is pulled through the stone or other hard material 25 by rotation of the drive pulley such as in the clockwise direction shown by arrow 32 in FIG. 1. The cutting chain 10 is inverted so that outward projections on its center links 14 extend outwardly of the side links to engage guide grooves 38 in a pair of guide and tension pulleys 34 and 36 which may be positioned, respectively, above the upper reach of the chain and below the lower reach of the chain, as shown in FIG. 1. Thus, each of the pulleys 34 and 36 is provided with a narrow rectangular groove 38 into which the center links 14 extend to guide the path of the chain and to provide lateral stability to the chain during cutting by preventing lateral movement of the chain, as shown in FIG. 4. The pulleys 34 and 36 also are spring or otherwise biased and thereby positioned to provide proper tension on the chain to maintain it in contact with the drive pulley and to enable efficient cutting of the stone or other hard material.

Figure 6:
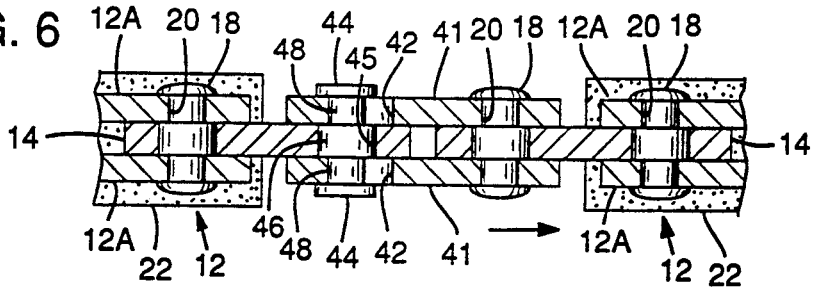
FIG. 6 is an enlarged section view of the connecting link and associated parts of the cutting chain when under tension, taken along the line 6—6 of FIG. 2.

The endless loop of cutting chain 10 is formed by a plurality of sections of chain of standard lengths which are interconnected by a releasable connection, including a connector pin 40 and a pair of connector links 41 as shown in FIGS. 2 and 6. The connector links, which may be rectangular side links are each provided with a circular pin opening 42 which is of slightly greater diameter than enlarged head portions 44 on the opposite ends of the connecting pin 40 so that such connecting pin will pass through such pin opening. A pin opening 45 of the approximately same diameter as opening 42 is provided in the center link connected to the connector links 41, and such center link opening may be the same size as the rivet openings in the other center links for rivets 18. The connecting pin 40 is provided with a center portion 46 of the same diameter as the two head portions 44, such center portion passing through the pin opening 45 in the center link 14. The connecting pin is provided with two grooved intermediate portions 48 of reduced diameter on opposite sides of the center portion 46 between the head portions 44 and such center portion. The grooves 48 of the pin, are of smaller diameter than the head portions 44 and are of substantially the same width or slightly larger than the thickness of the connecting link 41. Thus, when the connector pin 40 is inserted in pin openings 42 in the side connector links 41, such connector links are pulled into engagement with grooves 48 of the pin and shifted relative to the center link which engages the center portion 46 of such pin as shown in FIGS. 2 and 6, when the chain is driven into tension by the drive pulley.

Figure 7:
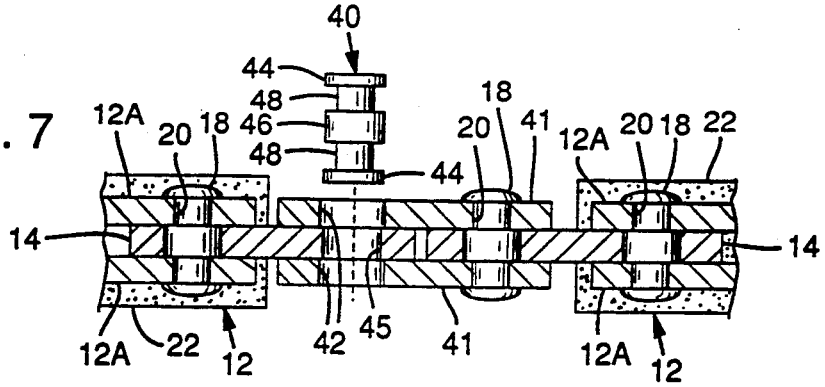
FIG. 7 is an enlarged section view similar to FIG. 6, but with the chain not under tension and showing the connecting pin removed from the connecting link.

The connector pin 40 holds the chain sections together, but allows the chain sections to be disconnected manually in the field without the use of special tools when the drive pulley is stopped and the chain is no longer under tension so that the pin holes may be positioned in alignment as shown in FIG. 7. Thus, the connecting pin 40 releasably connects standard length sections of chain together, while allowing such chain sections to be disconnected manually in the field in order to replace broken sections of chain or to change the length of the continuous loop of cutting chain to accommodate different cutting conditions, such as to shorten the chain when the cut is partially done. The drive pulley 28 is connected to a drive motor 29 that is mounted on a carriage 50 which travels on wheels 52 along a track 54 to move the drive pulley longitudinally away from the rock or concrete member 25 during cutting until the cut is finished. In some cases the amount of travel on the track is not sufficient to complete the cut. In these cases, when the cut is partially finished it may be necessary to shorten the cutting chain and to move the drive pulley carriage back to its starting point nearer the workpiece on the track in order to complete the cut. This shortening of the chain can be easily accomplished by removing a standard section of chain using the releasable connection including the connector pin 40 shown in FIGS. 2 and 6. The guide pulleys 34 and 36 are also mounted on the carriage for movement with the drive pulley during cutting. It should be noted that the guide pulleys 34 and 36 are not provided with an elastomer liner within the guide slot 38 of such pulleys, unlike the slot 26 in the drive pulley 28. Also, such guide slots are of much narrower width being only slightly larger that the width of the center links 14. However, the width of the slot 26, including the liner 30 of the drive pulley, must be slightly greater than the width of the cutting element 22 on the cutting links 12.

Since the abrasive cutting apparatus of the present invention avoids the use of a guide bar and sprocket, it is not subject to abrasion of these elements by rock dust or other comminuted material like a conventional chain saw. Instead of a guide bar, the lateral stability of the chain is achieved by engagement of the center links with the grooves 38 of the guide pulleys 34 and 36 which are positioned some distance from the cut 24 so they are not as exposed to rock dust as a guide bar. The same is true of the drive pulley compared to the sprocket of a chain saw.

It will be obvious to those having ordinary skill in the art that many changes may be made in the preferred embodiment of the invention. For example, different cutter links can be employed, like the individual side cutter links of U.S. Pat. No. 2,869,534 of Stihl or a chain of uni-link construction where each link of the chain is of the same shape with one end of the link being offset and overlapping the opposite end of the adjacent link which are pivotally connected by rivets. Therefore the scope of the invention should be determined by the following claims.

I claim:

1. Abrasive cutting apparatus, comprising:

motor driven chain drive means including a drive pulley, for driving an endless loop cutting chain in one direction about the loop; and a flexible cutting chain formed in an endless loop by pivotally interconnected links which cause the chain to move in one cutting plane, at least some of said links being inverted cutting links having abrasive cutting elements provided on an inner portion of each of said cutting links and facing inward of the loop, said abrasive cutting elements of said cutting links being engaged and driven by said drive pulley of said drive means.

2. Cutting apparatus in accordance with claim 1 in which the chain includes center links and side links positioned on opposite sides of the center links.

3. Cutting apparatus in accordance with claim 1 which also includes releasable connection means for releasably connecting sections of said cutting chain together to form said loop.

4. Cutting apparatus in accordance with claim 3 in which the releasable connection means includes connector links and connector pins which engage coupling holes in the connector links for connecting chain sections together to form said loop but can be released manually therefrom for disconnection of the chain sections.

5. Cutting apparatus in accordance with claim 4 in which a connector pin includes a pair of spaced grooves which engage pairs of side links on opposite sides of a center link.

6. Cutting apparatus in accordance with claim 5 in which the pin also includes, at its opposite ends a pair of heads of larger diameter than the groove portions of the pin and smaller diameter than the coupling holes in the connector links.

7. Cutting apparatus in accordance with claim 1 which also includes guide pulley means for engaging projections on links of the chain which extend outwardly of the loop beyond remainder portions of the links, for tensioning the chain and for guiding the movement of the chain to provide lateral stability to said chain.

8. Cutting apparatus in accordance with claim 2 in which the cutting links include side links which are separated by center links and are longitudinally spaced by other side links which are not cutting links.

9. Cutting apparatus in accordance with claim 8 in which cutter links are each formed by a pair of side links and a common cutting element formed of a matrix of bonded together abrasive particles which is affixed to said pair of side links.

10. Cutting apparatus in accordance with claim 1 in which the drive pulley includes a groove with a surface of elastomeric material which engages the abrasive cutting elements of the cutting links to drive the chain.

11. Abrasive cutting apparatus for cutting hard material, comprising:

motor driven chain drive means including a drive pulley, for driving an endless loop cutting chain in one direction about the loop;

a flexible cutting chain formed in an endless loop by pivotally interconnected links which cause the chain to move in one cutting plane, at least some of said links being inverted cutting links having abrasive cutting elements provided on an inner portion of each of said cutting links an facing inward of the loop, and at least some of said cutting links being drive links having abrasive cutting elements which engage said drive pulley of the drive means for moving the chain; and rotatable guide means spaced from said drive means for guiding the movement of said chain.

12. Cutting apparatus in accordance with claim 11 which also includes releasable connection means for releasably connecting sections of said cutting chain together to form said loop.

13. Cutting apparatus in accordance with claim 12 in which the releasable connection means includes connector pins which engage coupling holes in connector links for connecting chain sections together to form said loop but can be released manually therefrom for disconnection of the chain sections.

14. Cutting apparatus in accordance with claim 13 in which the connector pins include a pair of spaced grooves which engage pairs of side links on opposite sides of the center link.

15. Cutting apparatus in accordance with claim 15 in which the chain includes side links and center links between pairs of side links, which also includes pulley means engaging projections on the center links, which projections extend outwardly of the loop beyond the side links, for tensioning the chain and for guiding the movement of the chain to provide lateral stability to said chain.

16. Cutting apparatus in accordance with claim 11 in which the cutting links are side links which are separated by center links and are spaced longitudinally by other side links which are not cutting links.

17. Cutting apparatus in accordance with claim 16 in which cutting links are each formed by a pair of side links disposed in side by side, spaced relationship and a common cutting element formed of a matrix of bonded together abrasive particles is affixed to and spaces the inner edges of said pair of side links.

18. Cutting apparatus in accordance with claim 11 which also includes a pair of idler pulleys having grooves which engage the center links of he chain to tension said chain and which function as said guide means to guide its movement to provide lateral stability to the chain.

* * * * *